US010704171B2

(12) United States Patent
Evrard et al.

(10) Patent No.: US 10,704,171 B2
(45) Date of Patent: Jul. 7, 2020

(54) METHOD OF FABRICATING A NEEDLED FIBER STRUCTURE

(71) Applicant: ARIANEGROUP SAS, Paris (FR)

(72) Inventors: Hervé Evrard, Le Haillan (FR); Gareth Clarke, Saint-Medard-en-Jalles (FR); Edouard Borie, Eysines (FR); Thierry Constant, Ludon Medoc (FR)

(73) Assignee: ARIANEGROUP SAS, Paris (FR)

( * ) Notice: Subject to any disclaimer, the term of this patent is extended or adjusted under 35 U.S.C. 154(b) by 157 days.

(21) Appl. No.: 15/913,370

(22) Filed: Mar. 6, 2018

(65) Prior Publication Data

US 2018/0257331 A1 Sep. 13, 2018

(30) Foreign Application Priority Data

Mar. 7, 2017 (FR) ..... 17 51830

(51) Int. Cl.
*D04H 1/46* (2012.01)
*D04H 3/105* (2012.01)
*D04H 18/02* (2012.01)

(52) U.S. Cl.
CPC ..... *D04H 1/46* (2013.01); *D04H 3/105* (2013.01); *D04H 18/02* (2013.01)

(58) Field of Classification Search
CPC ..... D04H 18/02; D04H 18/00; D04H 1/46; D04H 3/105; D04H 5/02; D04H 1/4242;
(Continued)

(56) References Cited

U.S. PATENT DOCUMENTS 460,805 A * 10/1891 Whipple ..... D04H 18/02 28/114
3,431,611 A 3/1969 Rentz
(Continued)

FOREIGN PATENT DOCUMENTS

EP 0 683 261 A2 11/1995
EP 2 816 147 A1 12/2014
WO WO 97/20092 A1 6/1997

OTHER PUBLICATIONS

Search Report as issued in French Patent Application No. 1751830, dated Oct. 4, 2017.
(Continued)

*Primary Examiner* — Amy Vanatta
(74) *Attorney, Agent, or Firm* — Pillsbury Winthrop Shaw Pittman LLP

(57) ABSTRACT

A method of fabricating a needled fiber structure using a needling machine having a needling head with a plurality of needles, the method including placing a first fiber layer on a support; needling the first fiber layer, with the needling head being in a first position relative to the support, at least at the end of needling the first layer; after needling the first layer, implementing relative movement between the support and the needling head so as to cause the needling head to go from the first position relative to the support to a second position that is different from the first; placing a second fiber layer on the needled first fiber layer; and needling the second fiber layer placed on the first fiber layer, the needling head being in the second position relative to the support at least at the beginning of needling the second fiber layer.

5 Claims, 5 Drawing Sheets

(58) Field of Classification Search
CPC ..... D04H 1/498; D04H 3/102; D04H 1/488; B32B 2262/106; B32B 5/24
USPC ..... 28/114, 110
See application file for complete search history.

(56) References Cited

U.S. PATENT DOCUMENTS 3,613,190 A 10/1971 Crosby
3,845,529 A 11/1974 Van Deusen
3,909,891 A * 10/1975 Dilo ..... D04H 18/02 28/109
4,621,662 A * 11/1986 Olry ..... D04H 18/02 138/129
4,790,052 A * 12/1988 Olry ..... B29C 33/56 156/148
4,878,278 A * 11/1989 Hsu ..... D04H 1/498 28/142
5,513,423 A * 5/1996 Jakob ..... D04H 18/02 28/107
5,662,855 A * 9/1997 Liew ..... D04H 18/02 156/184
6,009,605 A * 1/2000 Olry ..... B29B 11/16 28/107
6,363,593 B1 * 4/2002 Duval ..... D04H 18/00 28/107
7,430,790 B1 10/2008 Bowles
2002/0133923 A1 9/2002 Duval
2009/0038129 A1 2/2009 Leger
2014/0373322 A1 * 12/2014 Gautier ..... D04H 1/4242 28/107
2016/0108567 A1 * 4/2016 Simpson ..... B29B 11/16 28/108

OTHER PUBLICATIONS

Non-Final Office Action as issued in U.S. Appl. No. 15/913,435, dated Feb. 24, 2020.

* cited by examiner

METHOD OF FABRICATING A NEEDLED FIBER STRUCTURE

CROSS-REFERENCE TO RELATED APPLICATION

This application claims priority to French Patent Application No. 1751830, filed Mar. 7, 2017, the entire content of which is incorporated herein by reference in its entirety.

BACKGROUND OF THE INVENTION

The present invention relates to the general field of methods of fabricating needled fiber structures suitable for being used in fabricating parts made of composite material.

Various types of needling machine are known that are suitable for making needled textile structures. In a first machine of plane type, fiber layers that are stacked on a table are needled, with the table moving horizontally in translation past the needling head, which is movable vertically. In a second machine of circular type, a continuous fiber layer that is wound around a rotary mandrel is needled. The mandrel presents a surface of revolution having the layer wound around it, with the layer being situated facing a needling head that is movable in a direction perpendicular to that surface.

When using one or the other of those machines for needling a plurality of superposed fiber layers, it is found that the resulting needled fiber structures present zones of weakness. These zones of weakness are due in particular to recurrent needling on the same zone for two consecutive fiber layers. In particular, when the needling head moves along the fiber layer for needling (e.g. as a result of the table moving in translation or of the mandrel rotating), successive passes of the head for two layers can produce holes that are in alignment in the travel direction of the layer (a phenomenon referred to as "lining"). Such alignment of holes within a given layer and for different layers can lead to premature breaking of the needled fiber structure along those lines of holes. Thereafter, it is found that parts made of composite material by densifying such needled fiber structures also suffer from mechanical strength problems, which is not desirable.

There therefore exists a need for a method of fabricating a needled textile structure on a needling machine of a plane or circular type that does not present the above-mentioned drawbacks.

OBJECT AND SUMMARY OF THE INVENTION

A main object of the present invention is thus to mitigate such drawbacks by proposing a method of fabricating a needled fiber structure using a needling machine having a needling head, the method comprising at least the following steps:

- placing a first fiber layer on a support;
- needling the first fiber layer, with the needling head being in a first position relative to the support, at least at the end of needling the first layer;
- after needling the first layer, implementing relative movement between the support and the needling head so as to cause the needling head to go from the first position relative to the support to a second position that is different from the first;
- placing a second fiber layer on the needled first fiber layer; and
- needling the second fiber layer placed on the first fiber layer, the needling head being in the second position relative to the support at least at the beginning of needling the second fiber layer.

The method of the invention serves to reduce the risk of needles of the needling head needling twice at the same locations for two successive fiber layers. Specifically, the step of performing relative movement between the support and the needling head, corresponding to shifting those elements relative to each other, serves to avoid the needles generally striking the same locations for two successive layers. In particular, the method of the invention makes it possible to avoid forming lines of needled holes (referred to as the "lining" phenomenon) for two successive layers, thereby reducing the problems of weakness to which they give rise. The parts made of composite material resulting from subsequent densification of a needled fiber structure obtained by the method of the invention thus present improved mechanical strength.

The support may be a table or a mandrel that is rotatable about an axis of rotation. When the support is a table, the needling head may move in translation during a needling step perpendicularly to the surface of the table with reciprocating vertical motion. In addition, the table may move in translation past the needling head in order to needle a fiber layer of size that is greater than the size of the needling head. When the support is a rotary mandrel, the needling head may move during a needling step perpendicularly to the surface of the mandrel with reciprocating vertical motion, i.e. in a direction that is radial relative to the axis of rotation of the mandrel.

In the following implementations, the support may advantageously be a table that is optionally movable in translation past the needling head.

In an implementation, the relative movement between the support and the needling head may comprise a relative movement in rotation between the support and the needling head.

In particular, the rotation of the support relative to the needling head may be a movement in rotation of the support about an axis perpendicular to a surface of the support.

In an implementation, the support may turn through a non-zero angle that is less than or equal to 5°, e.g. less than or equal to 2°. An angular range that is thus small serves to avoid the presence of "dead" zones in which the fiber layers are not needled.

In the implementations below, the support may advantageously be a mandrel that is rotatable about an axis of rotation and on which a fiber structure can be wound, a fiber structure layer forming one revolution around the mandrel, for example.

In an implementation, the relative movement between the support and the needling head may comprise a relative movement in translation between the support and the needling head.

In particular, the support of the needling machine may be rotatable about an axis of rotation, with the relative movement between the support and the needling head then being a relative movement in translation between the needling head and the support in a direction parallel to the axis of rotation of the support.

In an implementation, the needling head or the support may be moved in translation through a non-zero distance less than or equal to 30 millimeters (mm), e.g. less than or equal to 15 mm, in particular in order to reduce the presence of dead zones in the needled layers.

In another aspect, the invention also provides a method of fabricating a composite material part comprising fiber reinforcement densified by a matrix, the method comprising at least the following steps:

fabricating a needled fiber structure that is to form the fiber reinforcement of the part by a method as described above; and forming a matrix in the pores of the needled fiber structure so as to obtain the composite material part.

BRIEF DESCRIPTION OF THE DRAWINGS

Other characteristics and advantages of the present invention appear from the following description given with reference to the accompanying drawings, which show an implementation having no limiting character. In the figures.

DETAILED DESCRIPTION OF THE INVENTION

Figure 1A:
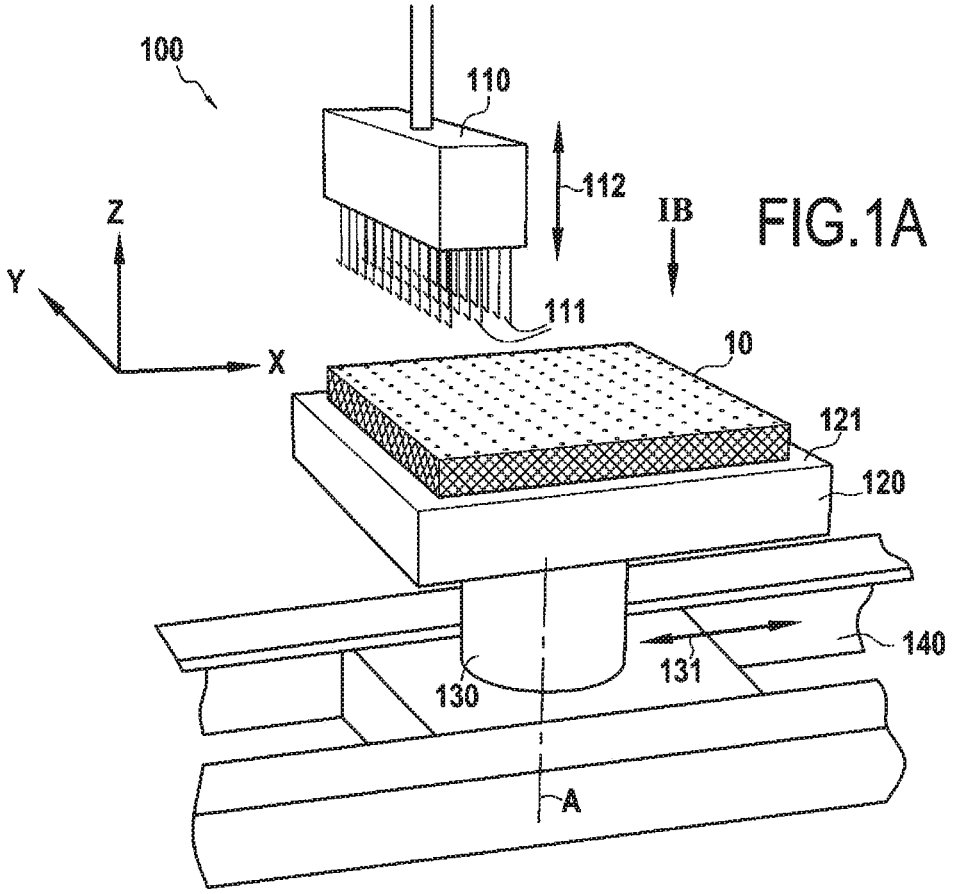
FIGS. 1A to 3B shows the steps of a method in a first implementation of the invention, making use of a plane type needling machine.

FIGS. 1A to 3B show the steps of a method in a first implementation of the invention. In this example, use is made of a needling machine 100 of the plane type, having a needling head 110 and a support that is constituted by a table 120. The needling head 110 carries a determined number of needles 111 that have barbs, hooks, or forks for taking fibers from the fiber layers and transferring them through those layers when they penetrate through them. In known manner, the needles 111 may be arranged in a plurality of rows of needles 111. The needling head 110 can move vertically, i.e. in a direction Z as shown in the figures, above the table 120. The needling head 110 can in particular move downwards and upwards along the vertical direction Z with reciprocating vertical motion relative to the table 120, as represented by double-headed arrow 112. The table 120 extends in horizontal directions X and Y that are perpendicular to the direction Z. In this example, the table 120 is mounted on a post 130 that is movable in translation in a rail 140 extending along the direction X so that the table 120 can be moved past the needling head 110 in translation in a straight line along the direction X (double-headed arrow 131). In the example shown, the needling head 110 cannot move in both directions X and Y. In the example shown, the table 120 is rotatable about an axis A, parallel to the axis Z and perpendicular to the surface 121 of the table on which fiber layers are to be needled. It should be observed that in an equivalent variant that is not shown, the table 120 could be stationary in the direction X with the needling head 110 being movable in translation in the direction X.

In FIG. 1A, a first fiber layer 10 is placed and held on the table 120. The fiber layer 10 has already been needled by the needling head 110, e.g. by causing the needling head 110 to perform back-and-forth motion while moving the table 120 in the rail 140. During the needling, and in well-known manner, the needling head 110 performs motion as represented by the double-headed arrow 112. The needles 111 thus penetrate into the fiber layer(s) present on the table so that fibers interpenetrate the various fiber layers along the direction Z. The table 120 may be moved past the head 110 during needling in steps, i.e. alternating between stages of movement and stages of stopping, with needling being performed by the head 120 during the stages of stopping. This makes it possible advantageously to reduce the shear in the fiber layer during needling and to further improve the mechanical properties of the part.

Figure 1B:
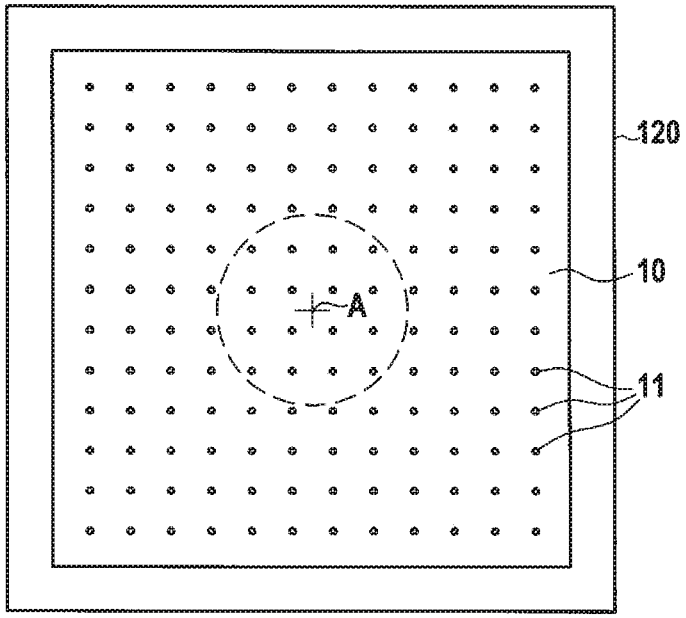
Figure 2:
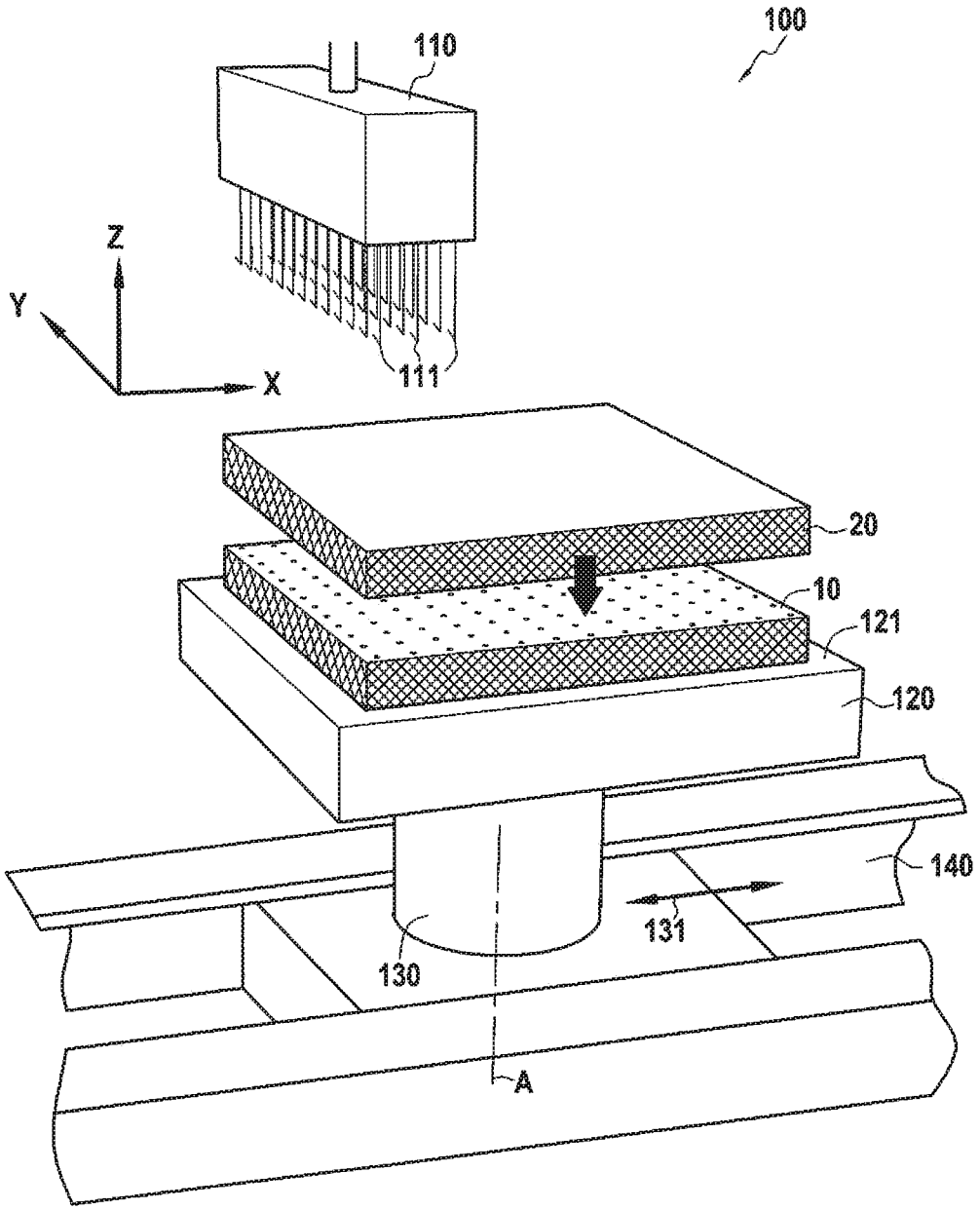

FIG. 1B is a plan view of a first fiber layer 10 on the table 120, together with holes 11 corresponding to the locations where the needles have penetrated into the first fiber layer 10 while it was being needled. In the example shown, the needles 111 are distributed uniformly over a surface of the needling head 110. After this needling step, the needling head 110 is in a first position relative to the table 120, as shown in FIGS. 1A, 1B, and 2. This first needle is defined in this example in particular by the orientation of the table 120 relative to the needling head 110.

In FIG. 2, a second fiber layer 20 is put into place on the already-needled first fiber layer 10. In this example, the edges of the two fiber layers 10 and 20 are put into alignment on the table 120. In a variant, it is possible to place the second layer 20 in some other manner on the first layer 10.

Figure 3A:
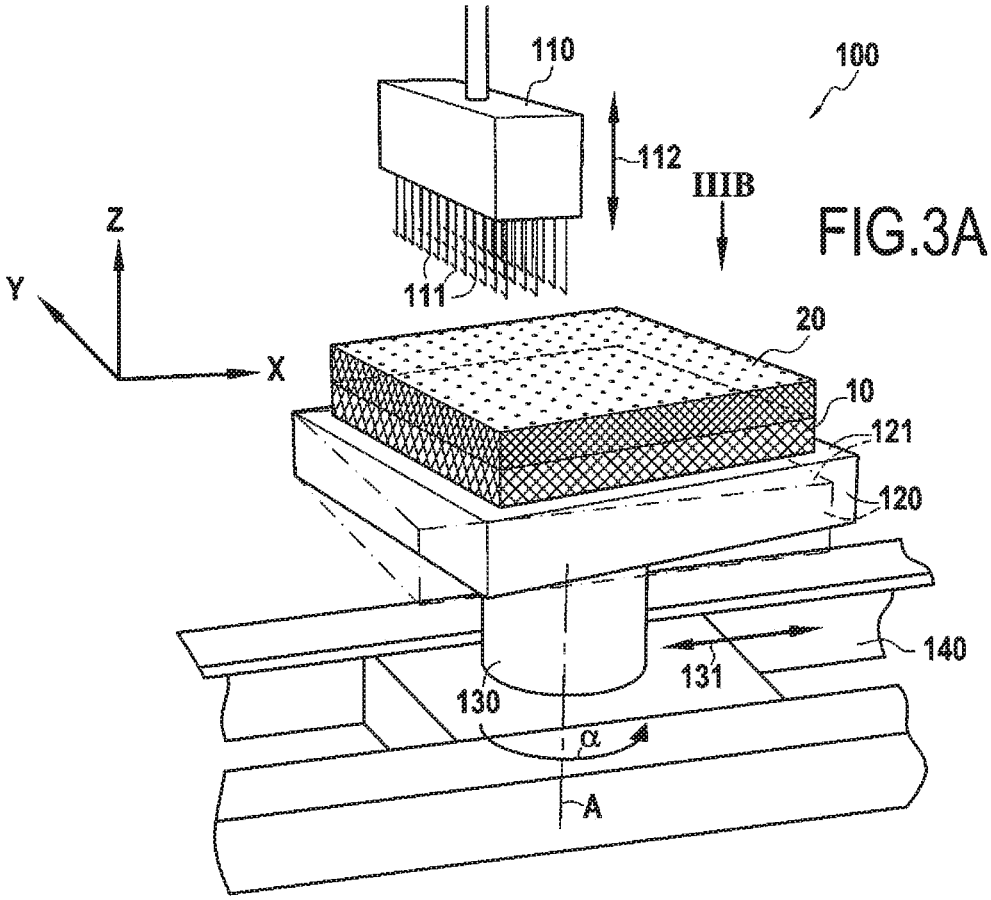

Thereafter, as shown in FIG. 3A, the table 120 (on which both fiber layers 10 and 20 are present) is caused to move relative to the needling head 110. In this example, this step corresponds to turning the table 120 about its axis of rotation A through an angle $\alpha$, while the needling head 110 in this example is horizontally stationary. The angle $\alpha$ may be less than or equal to 5° (i.e. lying in the range −5° to +5° relative to the first position), or indeed less than or equal to 2° (i.e. lying in the range −2° to +2° relative to the first position), so as to limit the size of dead zones, i.e. zones that are not needled, in the fiber layers. Naturally, a is not equal to 0. The needling head 110 is thus in a second position that is different from the first position.

After the table 120 has moved relative to the needling head 110, the second fiber layer 20 is needled with the needling head 110 being in the second position at least at the beginning of needling the second layer 20. The second fiber layer 20 may be needled in a manner that is identical to the needling of the first fiber layer 10. In particular, the table 120 may also move past the needling head 110 along the direction X and may perform go-and-return motion in order to needle the entire second layer 20.

Figure 3B:
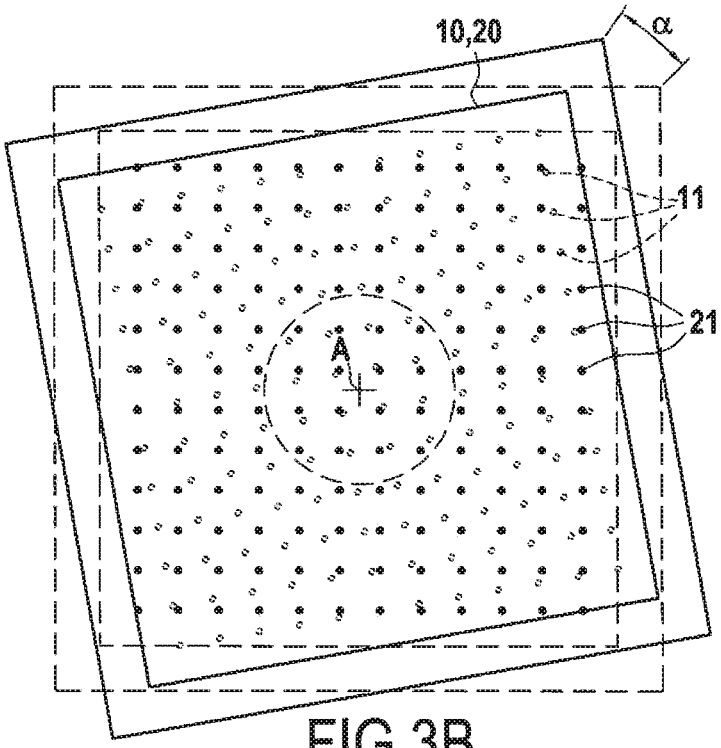

In FIG. 3B, the first position of the table 120 is drawn in dashed lines while the second position of the table 120 is drawn in continuous lines. The positions of the holes 11 made in the first layer 10 while needling the first layer 10 can also be seen, as can the positions of the holes 21 made during needling of the second layer 20. It can thus be seen that the needles do not strike the layers 10 and 20 at the same location, thereby making it possible to reduce the formation of zones of weakness within the resulting needled fiber structure, in particular by preventing any lining phenomenon.

FIGS. 4A to 5B show the steps of a method in a second implementation of the invention. In this example, use is made of a needling machine 200 that is of circular type, comprising a needling head 210 provided with needles 211 and a support that is constituted in this example by a mandrel 220 around which a fiber structure 30 is to be wound. The mandrel 220 is rotatable about an axis B. During needling, the needling head 210 can move in a direction Z perpendicular to the surface of the mandrel, this direction also corresponding to a direction that is radial relative to the axis B of the mandrel 220. In this example, the mandrel 220 is movable only in rotation about the axis B, and the needling head 210 is movable in translation only along the directions X and Z. The fiber structure 30 may be in the form of a fiber strip stored on a delivery mandrel 230.

Below, it is assumed that when the fiber structure 30 is wound through less than one revolution on the mandrel 220, the wound portion forms a first fiber layer 31 on the mandrel 220. When the structure 30 is wound through more than one revolution and less than two revolutions, the portion covering the first layer 31 forms a second fiber layer 32 on the mandrel 220.

In known manner, in order to needle the first layer 31, the mandrel 220 is turned progressively (arrow 221) in order to cause the first layer 31 to move past the needling head 210. At the same time, the needling head 210 is driven with motion represented by double-headed arrow 212 in order to needle the entire first layer 31. After the first layer 31 has been needled, the needling head 210 is in a first position relative to the mandrel 220. In this example, this first position is defined in particular by the position of the needling head 210 along the axis X relative to the mandrel 220. As in the above example, the travel of the fiber structure 30 past the needling head 210 may take place in steps, in particular in order to reduce shear in the fiber layer during needling.

Figure 4A:
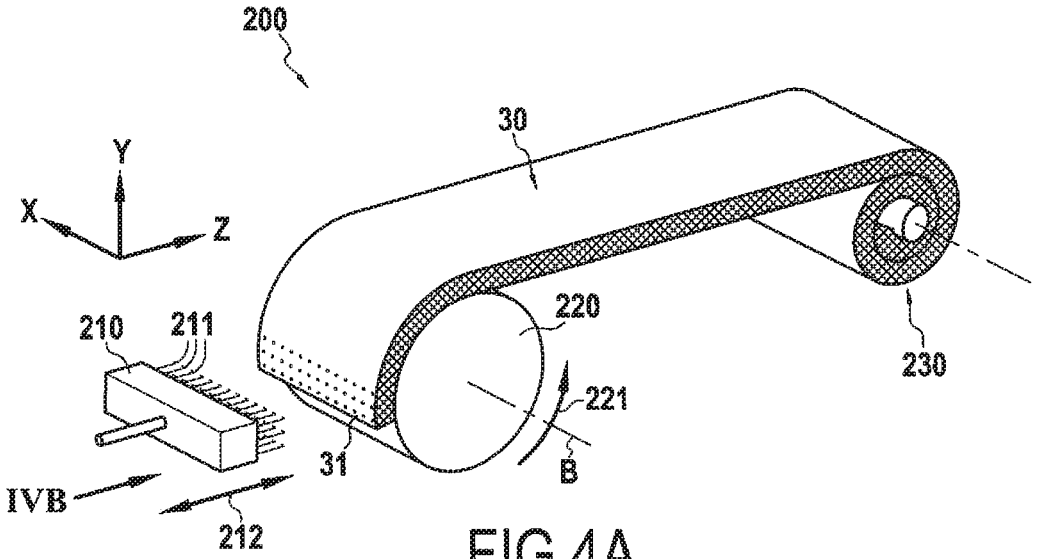
FIGS. 4A to 5B show the steps of a method in a second implementation of the invention, making use of a plane type needling machine.
Figure 4B:
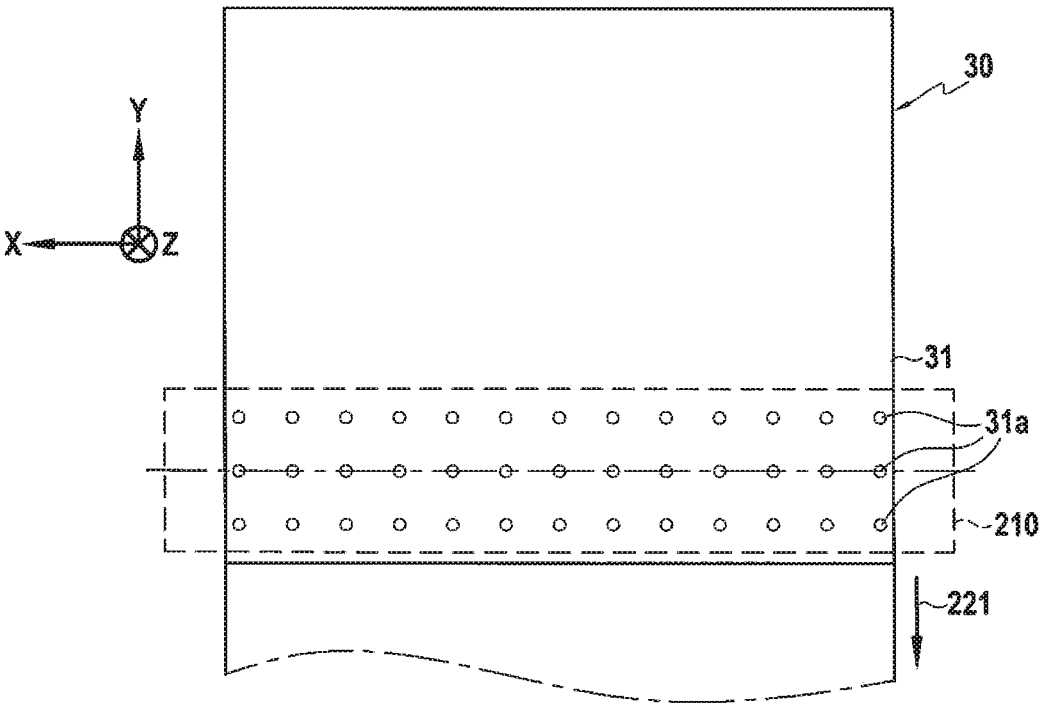

In similar manner to the above example, FIG. 4B is a view of the first layer 31 at the beginning of needling, and it shows the positions of the resulting holes 31*a*.

Figure 5A:
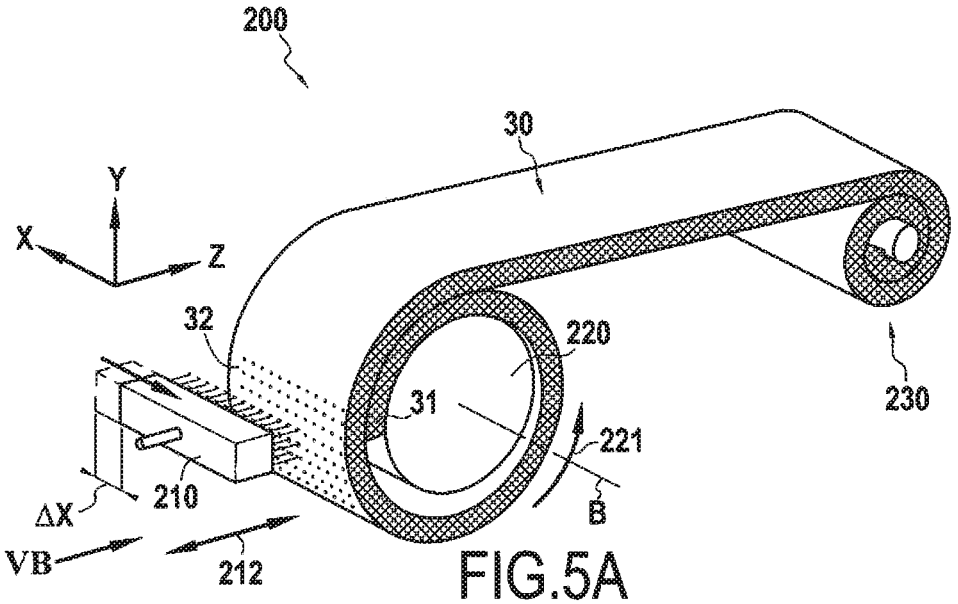

Thereafter, as shown in FIG. 5A, a step is performed in which the mandrel 220 (now having two fiber layers 31 and 32 present thereon) is moved relative to the needling head 210. In this example, this step corresponds to moving the needling head 210 in translation through a distance ΔX along the direction X parallel to the axis of rotation B of the mandrel. The distance ΔX may be less than or equal to 30 mm (i.e. the movement may lie in the range −30 mm to +30 mm relative to the first position), or indeed it may be less than or equal to 15 mm (i.e. lying in the range −15 mm to +15 mm relative to the first position), so as to limit the size of dead zones, i.e. zones that are not needled, in the fiber layers. Naturally, ΔX is not equal to 0. The needling head 210 is thus in a second position, that is different from the first position.

After relative movement between the mandrel 220 and the needling head 210, the second fiber layer 32 is needled with the needling head 210 being in the second position, at least at the beginning of needling the second fiber layer 32. The second fiber layer 32 can be needled in a manner that is identical to the needling of the first fiber layer 31. In particular, the mandrel 220 may turn about the axis B so as to cause the second layer 32 to move past the needling head 210, which is driven with back-and-forth motion along the direction Z.

Figure 5B:
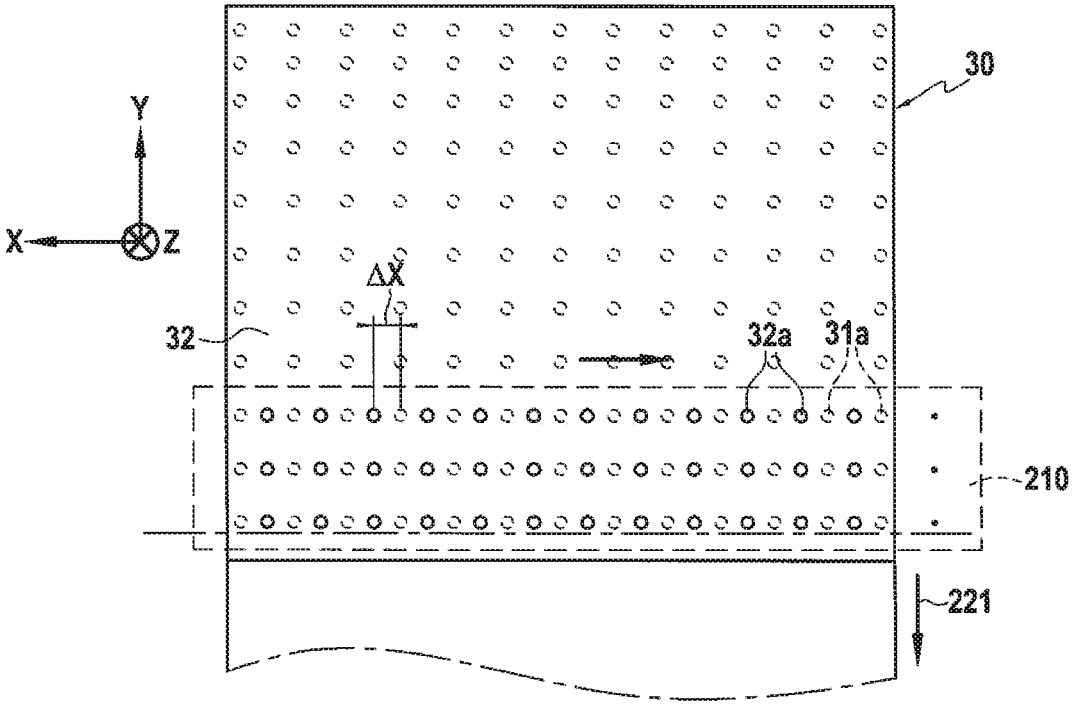

In FIG. 5B, the first position of the head 210 is drawn in dashed lines and the second position of the head 210 is drawn in continuous lines. There can also be seen the positions of the holes 31*a* made in the first layer 31 during needling of the first layer 31, and the positions of the holes 32*a* made during needling of the second layer 32. It can thus be seen that the needles do not strike the layers 31 and 32 in the same locations, thereby reducing the formation of zones of weakness within the resulting needled fiber structure, in particular by preventing the lining phenomenon.

Implementations of methods of the invention are described above with reference to a needling machine 100 of the plane type and a needling machine 200 of the circular type. In both of those machines 100 and 200, the steps of moving the support relative to the needling head correspond to particular movements of the support or of the head, e.g. a movement in translation or in rotation, adapted in particular to the machine in question. Naturally, it would not go beyond the ambit of the present invention for the step of moving the support and the needling head relative to each other to comprise a succession of a plurality of types of movement, e.g. a movement in translation followed by a movement in rotation, or vice versa.

By way of example, a fiber layer may comprise a sheet of unidirectional fibers, or a textile sheet presenting two-dimensional weaving. The fibers of the fiber layer may be fibers made of a refractory material such as carbon or ceramic fibers, e.g. fibers made of silicon carbide, or they may be glass fibers.

In addition, for reasons of simplification, the implementations of methods of the invention are described for needling a stack of only two fiber layers, however it is clear that the invention applies to needling a larger number of fiber layers, which may be of various shapes and dimensions. Furthermore, when needling a fiber layer, another underlying fiber layer is generally present. In the example shown, the fiber layer underlying the first layer 10 or 21 is not shown. In certain circumstances, it should be observed that it is possible to needle a single fiber layer without an underlying fiber layer being present. Under such circumstances, it is possible to interpose a layer of felt (not shown) between the table or the mandrel and the first fiber layer.

Furthermore, when the method of the invention is repeated, e.g. when stacking a third fiber layer on the second, followed by a fourth on the third, etc., it may be advantageous to select the value for the angle of rotation α or for the distance ΔX moved in translation in random manner for each step of relative movement between the support and the needling head that is undertaken between each needling step.

In the present description, the term "lying in the range . . . to . . . " should be understood as including the bounds.

The invention claimed is:

1. A method of fabricating a needled fiber structure using a needling machine having a needling head with a plurality of needles, the method comprising:

placing a first fiber layer on a support;

needling the first fiber layer, with the needling head being in a first position relative to the support, at least at the end of needling the first layer;

after needling the first fiber layer and prior to needling a second fiber layer on the needled first fiber layer, implementing relative movement between the support and the needling head so as to cause the needling head to go from the first position relative to the support to a second position that is different from the first position;

placing the second fiber layer on the needled first fiber layer; and needling the second fiber layer placed on the first fiber layer, the needling head being in the second position relative to the support at least at the beginning of needling the second fiber layer;

wherein the relative movement is configured so that the needles of the needling head do not strike the first and second fiber layers at the same locations; and wherein (i) the relative movement comprises relative movement in rotation between the support and the needling head, or (ii) the support is a rotary mandrel and the relative movement comprises relative movement in translation between the needling head and the support in a direction parallel to an axis of rotation of the support.

2. A method according to claim 1, wherein, when (i) the relative movement comprises a relative movement in rotation between the support and the needling head, the movement in rotation of the support relative to the needling head is a rotation of the support about an axis perpendicular to a surface of the support.

3. A method according to claim 1, wherein, when (i) the relative movement comprises a relative movement in rotation between the support and the needling head, the support turns relative to the needling head through a non-zero angle that is less than or equal to 5°.

4. A method according to claim 1, wherein, when (ii) the support is a rotary mandrel and the relative movement comprises relative movement in translation between the needling head and the support in a direction parallel to an axis of rotation of the support, the needling head or the support is moved in translation through a non-zero distance that is less than or equal to 30 mm.

5. A method of fabricating a composite material part comprising fiber reinforcement densified by a matrix, the method comprising:

fabricating a needled fiber structure that is to form the fiber reinforcement of the part by a method according to claim 1; and forming a matrix in pores of the needled fiber structure so as to obtain the composite material part.

* * * * *